US010793790B2

(12) United States Patent
Heraud et al.

(10) Patent No.: US 10,793,790 B2
(45) Date of Patent: Oct. 6, 2020

(54) STORAGE OF FISCHER-TROPSCH EFFLUENTS

(71) Applicant: IFP Energies nouvelles, Rueil-Malmaison (FR)

(72) Inventors: Jean-Philippe Heraud, Rueil-Malamison (FR); Aline Grezaud, Rueil-Malmaison (FR)

(73) Assignee: IFP Energies nouvelles, Rueil-Malmaison (FR)

( * ) Notice: Subject to any disclaimer, the term of this patent is extended or adjusted under 35 U.S.C. 154(b) by 0 days.

(21) Appl. No.: 16/512,995

(22) Filed: Jul. 16, 2019

(65) Prior Publication Data

US 2020/0024529 A1 Jan. 23, 2020

(30) Foreign Application Priority Data

Jul. 18, 2018 (FR) ..... 18 56668

(51) Int. Cl.
*C10G 65/12* (2006.01)
*C10G 47/14* (2006.01)

(52) U.S. Cl.
CPC ..... *C10G 65/12* (2013.01); *C10G 47/14* (2013.01); *C10G 2300/1022* (2013.01); *C10G 2300/301* (2013.01); *C10G 2300/4006* (2013.01); *C10G 2300/4012* (2013.01); *C10G 2300/4018* (2013.01); *C10G 2300/4031* (2013.01)

(58) Field of Classification Search
CPC ..... C10G 65/043; C10G 65/12; C10G 47/14; C10G 2/00; C10G 2300/301; C10G 2300/1022; C10G 2300/4006; C10G 2300/4012; C10G 2300/4018; C10G 2300/4031
See application file for complete search history.

(56) References Cited

U.S. PATENT DOCUMENTS 8,906,222 B2 12/2014 Nakashizu et al.
2004/0259961 A1 12/2004 O

FOREIGN PATENT DOCUMENTS

EP 2233549 B1 7/2016
WO 16156850 A1 10/2016

OTHER PUBLICATIONS

Search report in FR1856668 dated Mar. 13, 2019 (pp. 1-2).

*Primary Examiner* — Brian A McCaig
(74) *Attorney, Agent, or Firm* — Millen White Zelano and Branigan, PC; Csaba Henter

(57) ABSTRACT

Process for the production of middle distillates from a paraffinic feedstock produced by Fischer-Tropsch synthesis comprising at least one light fraction, known as condensate, and a heavy fraction, known as waxes, in which:

the said light fraction is stored in a vessel (B) maintained under an inert atmosphere and in which the temperature inside the vessel is maintained at a value of less than 20° C.;

the said heavy fraction is stored in a vessel (C) maintained under an inert atmosphere and in which the temperature inside the vessel is maintained at a value of between 80 and 230° C.

11 Claims, 2 Drawing Sheets

STORAGE OF FISCHER-TROPSCH EFFLUENTS

TECHNICAL FIELD

The present invention relates to the field of the storage of the effluents resulting from a Fischer-Tropsch unit and more particularly of the light fraction, also known as condensate, obtained after separation from the paraffinic feedstock.

STATE OF THE ART

The Fischer-Tropsch (FT) process makes it possible to produce synthetic hydrocarbons from a gaseous feedstock predominantly composed of hydrogen and of carbon monoxide, also known as synthesis gas ($CO+H_2$).

In particular, in the low-temperature Fischer-Tropsch process, the synthesis gas ($CO+H_2$) is converted catalytically into water, olefins, oxygen-comprising products and hydrocarbons in the gas, liquid or solid form under standard conditions. After separation of the water, the synthetic hydrocarbons obtained are predominantly composed of predominantly linear paraffins but also contain olefins and oxygen-comprising products.

Generally, the effluent resulting from the Fischer-Tropsch process is, at the outlet of the Fischer-Tropsch synthesis unit, divided into two fractions: a light fraction, known as condensate, and a heavy fraction, known as waxes. These synthetic hydrocarbons produced cannot be directly incorporated in conventional fuel pools or used as lubricants. By way of example, the pour point of a paraffin comprising 20 carbon atoms and having a boiling point at 340° C. is approximately 37° C., which makes its direct incorporation in the gas oil cut impossible due to the required specification of −15° C. A stage of hydroisomerization of linear paraffins is necessary in order to lower the pour points of the different hydrocarbon compounds and to thus improve the properties of the kerosene and gas oil cuts in order to observe the specifications. Moreover, treatment stages are necessary in order to remove the olefinic and oxygen-comprising compounds and to increase the yield of middle distillates.

Typically, the condensates and the waxes produced by the Fischer-Tropsch synthesis are sent directly to a hydrotreating unit and then a hydrocracking/hydroisomerization unit. This mode of operation requires that the units located downstream of the Fischer-Tropsch unit be permanently available. Industrially, this availability is difficult to achieve in view of the numerous dependencies of this unit (electricity, cooling water, hydrogen, and the like). Thus, the mean stream factor of this type of unit is between 80% and 60%, which represents approximately between 7000 hours and 7900 hours of operation.

In the event of shutdown of the hydrotreating unit and/or of the hydrocracking/hydroisomerization unit, one solution would consist in shutting down the operation of the Fischer-Tropsch unit. However, this solution is difficult to envisage from an industrial viewpoint, the restarting of such a unit being complex to carry out, and significantly reduces the production of effluents.

One possible solution consists in storing the effluents resulting from the Fischer-Tropsch synthesis in holding tanks. The document U.S. Pat. No. 8,906,222 describes the storage of the waxes resulting from the Fischer-Tropsch synthesis in a vessel maintained at a temperature of between 90° C. and 130° C., in order to ensure the flow of the products, and under an inert atmosphere, in order to prevent the formation of peroxides and/or of rubbers. The waxes, corresponding to the hydrocarbon fraction having a number of carbon atoms of greater than 20, have the specific feature of being in the solid form at ambient temperature. However, this document does not disclose in what way the light fraction resulting from the Fischer-Tropsch unit should be stored. Nevertheless, precautions have to be particularly taken as regards the storage of the light fraction resulting from the Fischer-Tropsch synthesis. This is because this fraction comprises a large amount of olefins. These olefins can be in the form of monoolefins or of diolefins. The presence of diolefins can result in the formation of polymers. These polymers are not desired in the process as they form rubbers which block the catalytic beds of the hydrotreating reactor and possibly of the hydrocracking/hydroisomerization reactor which are located downstream of the Fischer-Tropsch unit.

SUBJECT-MATTERS OF THE INVENTION

The Applicant Company has discovered, surprisingly, that, in order to prevent the formation of rubbers undesirable for the hydrotreating and/or hydrocracking/hydroisomerization stage, the light fraction resulting from the Fischer-Tropsch effluent has to be stored in a vessel at a temperature of less than 20° C. and more preferably of less than 15° C. and more preferably still of less than 10° C.

A first subject-matter according to the invention relates to a process for the production of middle distillates from a paraffinic feedstock produced by Fischer-Tropsch synthesis comprising at least the following stages:

a) the said paraffinic feedstock resulting from a Fischer-Tropsch unit (A) is recovered, the said paraffinic feedstock comprising at least a light fraction, known as condensate, and a heavy fraction, known as waxes;

b) a least a part of the said light fraction and at least a part of the said heavy fraction which are obtained on conclusion of stage a) are sent, as a mixture, to a hydrotreating unit (D) in the presence of hydrogen and a hydrotreating catalyst in order to obtain a first hydrotreated effluent;

c) at least a part of the first hydrotreated effluent obtained on conclusion of stage b) is sent to a hydrocracking/hydroisomerization unit (E) in the presence of hydrogen and of a hydrocracking/hydroisomerization catalyst in order to obtain a second effluent;

d) the second effluent resulting from the hydrocracking/hydroisomerization unit is separated in a fractionation unit (F) in order to obtain at least a naphtha cut having a maximum boiling point of less than 180° C., a middle distillates fraction and an unconverted heavy fraction;

which process being characterized in that, when the hydrotreating unit (D) and/or the hydrocracking/hydroisomerization unit (E) is at shutdown, then:

the said light fraction is stored in a vessel (B) maintained under an inert atmosphere and in which the temperature inside the vessel is maintained at a value of less than 20° C.; and/or the said heavy fraction is stored in a vessel (C) maintained under an inert atmosphere and in which the temperature inside the vessel is maintained at a value of between 80 and 230° C.

In one embodiment according to the invention, the said light fraction is stored in the vessel (B) at a temperature of less than 15° C.

In one embodiment according to the invention, the said vessel (B) is maintained under an inert atmosphere by flushing by means of an inert gas and by creating an excess pressure of at most 0.1 MPa with respect to the pressure within the said vessel (B).

In one embodiment according to the invention, the said light fraction exhibits an initial boiling point $T_1$ of between 15 and 50° C.

In one embodiment according to the invention, the said heavy fraction exhibits an initial boiling point $T_2$ of between 100 and 300° C.

In one embodiment according to the invention, the said hydrotreating stage b) is carried out at a temperature of between 250 and 450° C., at a pressure of between 0.5 and 15 MPa, an hourly space velocity of between 0.1 and 40 $h^{-1}$ and a hydrogen flow rate adjusted in order to obtain a ratio of between 100 and 3000 standard litres per litre.

In one embodiment according to the invention, the hydrocracking/hydroisomerization stage c) is carried out at a temperature of between 250° C. and 450° C., at a pressure of between 0.2 and 15 MPa, at an hourly space velocity of between 0.1 and 10 $h^{-1}$ and at a hydrogen flow rate adjusted in order to obtain a ratio of between 100 and 2000 standard litres of hydrogen per litre of feedstock.

In one embodiment according to the invention, the hydrocracking/hydroisomerization catalyst employed comprises at least one hydro/dehydrogenating metal chosen from the group formed by the metals of Group VIb and of Group VIII of the Periodic Table and at least one Bronsted acid solid, and optionally a binder.

Preferably, the said metal from Group VIII is chosen from platinum and palladium, taken alone or as a mixture, which is/are active in its/their reduced form.

In one embodiment according to the invention, the hydrotreating catalyst employed comprises at least one metal from the group of metals formed by nickel, molybdenum, tungsten, cobalt, ruthenium, indium, palladium and platinum, alone or as a mixture, and comprises at least one support chosen from aluminas, boron oxides, magnesia, zirconia, titanium oxides and clays or a combination of these oxides.

Another subject-matter according to the invention relates to a process for the storage of a light fraction of an effluent resulting from the Fischer-Tropsch synthesis, the said light fraction exhibiting an initial boiling point $T_1$ of between 15 and 50° C., the said light fraction being stored in a vessel maintained under an inert atmosphere and in which the temperature inside the vessel is maintained at a value of less than 20° C.

DETAILED DESCRIPTION OF THE INVENTION

Within the meaning of the present invention, the different embodiments presented can be used alone or in combination with one another, without any limit to the combinations. A first subject-matter according to the invention relates to a process for the production of middle distillates from a paraffinic feedstock produced by Fischer-Tropsch synthesis comprising at least the following stages:

a) the said paraffinic feedstock resulting from a Fischer-Tropsch unit (A) is recovered, the said paraffinic feedstock comprising at least a light fraction, known as condensate, and a heavy fraction, known as waxes;

b) a least a part of the said light fraction and at least a part of the said heavy fraction which are obtained on conclusion of stage a) are sent, as a mixture (4), to a hydrotreating unit (D) in the presence of hydrogen and a hydrotreating catalyst in order to obtain a first hydrotreated effluent (5);

c) at least a part of the first hydrotreated effluent (5) obtained on conclusion of stage b) is sent to a hydrocracking/hydroisomerization unit (E) in the presence of hydrogen and of a hydrocracking/hydroisomerization catalyst in order to obtain a second effluent (6);

d) the second effluent (6) resulting from the hydrocracking/hydroisomerization unit is separated in a fractionation unit (F) in order to obtain at least a naphtha cut (7) having a maximum boiling point of less than 180° C., a middle distillates fraction (8,9) having a maximum boiling point of less than 380° C. and an unconverted heavy fraction (10);

which process being characterized in that, when the hydrotreating unit (D) and/or the hydrocracking/hydroisomerization unit (E) is at shutdown, then:

the said light fraction (2) obtained on conclusion of stage a) is stored in a vessel (B) maintained under an inert atmosphere and in which the temperature inside the vessel is maintained at a value of less than or equal to 20° C.; and/or the said heavy fraction (3) obtained on conclusion of stage a) is stored in a vessel (C) maintained under an inert atmosphere and in which the temperature inside the vessel is maintained at a value of between 80 and 230° C.

Stages a) to d) of the process are described in detail below.

a) Fischer-Tropsch Synthesis

The Fischer-Tropsch process, which is well known to a person skilled in the art, makes it possible to produce synthetic hydrocarbons from a gaseous feedstock predominantly composed of hydrogen and of carbon monoxide, also known as synthesis gas ($CO+H_2$).

The synthesis gas ($CO+H_2$) feeding the Fischer-Tropsch process can advantageously be produced from natural gas, from coal, from biomass, from any source of hydrocarbon compounds or from a mixture of these sources.

In particular, in the low-temperature Fischer-Tropsch process, the synthesis gas ($CO+H_2$) is converted catalytically into water, olefins, oxygen-comprising products and hydrocarbons in the gas, liquid or solid form at ambient temperature. After separation of the water, the synthetic hydrocarbons obtained are predominantly composed of paraffins but also contain olefins and oxygen-comprising products.

Preferably, the effluent resulting from the Fischer-Tropsch process comprises a content of n-paraffins of greater than 70% by weight and more preferably still of greater than 80% by weight, with respect to the total weight of the said effluent.

Preferably, the paraffinic effluent resulting from the Fischer-Tropsch process is free of heteroatomic impurities, such as, for example, sulfur, nitrogen or metals.

Preferably, the paraffinic effluent resulting from the Fischer-Tropsch process comprises paraffins having a chain length of between 5 and 100 carbon atoms, in a preferred way between 5 and 90 carbon atoms and in a more preferred way between 10 and 90 carbon atoms.

In accordance with the invention, the paraffinic effluent resulting from the Fischer-Tropsch process comprises at least two fractions at the outlet of the Fischer-Tropsch synthesis unit: a light fraction, known as condensate, and a heavy fraction, known as waxes.

The light fraction, known as condensate, corresponds to the hydrocarbons in the gas state under the conditions of the Fischer-Tropsch reaction and the heavy fraction, known as waxes, corresponds to the hydrocarbons in the liquid state under the conditions of the Fischer-Tropsch reaction.

The condensates light fraction exhibits an initial boiling point $T_1$ of between 15 and 50° C. and preferably between 25 and 40° C.

The waxes heavy fraction exhibits an initial boiling point $T_2$ of between 100 and 300° C. and preferably between 125 and 200° C.

Preferably, the said heavy fraction corresponds to a paraffinic fraction having a number of carbon atoms of greater than 10 and preferably of greater than 22. This heavy fraction has the distinguishing feature, due to its composition, formed of n-paraffins having a high number of carbon atoms which can range up to 90, of being solid at ambient temperature.

In the light fraction, the content of paraffins is greater than 70% by weight, with respect to the total weight of the said light fraction, the content of olefins is less than 20% by weight and the content of oxygen-comprising compounds is less than 10% by weight, the contents being expressed as percentage by weight with respect to the total weight of the said light fraction. In the heavy fraction, the content of paraffins is greater than 80% by weight, the content of olefins is less than 15% by weight and the content of oxygen-comprising compounds is less than 5% by weight, the contents being expressed as percentage by weight with respect to the total weight of the said heavy fraction.

b) Hydrotreating

The light fraction and the heavy fraction resulting from the Fischer-Tropsch effluent are sent to a hydrotreating unit in the presence of a hydrotreating catalyst and which operates at a temperature of between 250 and 450° C., at a pressure of between 0.5 and 15 MPa, at a hydrogen flow rate adjusted in order to obtain a ratio of between 100 and 3000 standard litres per litre, and at an hourly space velocity of between 0.1 and 40 $h^{-1}$.

Preferably, the hydrotreating stage is carried out at a temperature of between 300 and 400° C. and preferably between 330 and 360° C., at a pressure of between 0.5 and 0.7 MPa, at a hydrogen flow rate adjusted in order to obtain a ratio of between 250 and 2000 standard litres per litre and preferably between 500 and 1500 standard litres per litre, and at an hourly space velocity of between 0.25 and 20 $h^{-1}$ and preferably between 0.5 and 10 $h^{-1}$.

The said hydrotreating stage makes it possible to reduce the content of olefinic and unsaturated compounds and also to optionally decompose the oxygen-comprising compounds present in the light and/or heavy fraction.

The hydrotreating catalyst employed in the hydrotreating stages is a conventional hydrotreating catalyst. The said catalyst comprises at least one metal from Group VIII and/or from Group VI of the Periodic Table of the Elements. Preferably, the catalyst comprises at least one metal from the group of metals formed by nickel, molybdenum, tungsten, cobalt, ruthenium, indium, palladium and platinum, alone or as a mixture, and comprises at least one support chosen from aluminas, boron oxides, magnesia, zirconia, titanium oxides and clays or a combination of these oxides; preferably, the said support is an alumina. The said catalysts can advantageously be prepared by any method known to a person skilled in the art or else can be acquired from companies which are specialists in the manufacture and the sale of catalysts.

In the case of the use of non-noble metals from Group VIII, a combination of at least one metal from group VI, preferably molybdenum or tungsten, and of at least one metal from Group VIII, preferably cobalt and nickel, of the Periodic Table of the Elements is advantageously used. The concentration of non-noble metal from Group VIII, when the latter is used, is advantageously from 0.01% to 15% by weight of oxide equivalent, with respect to the finished catalyst, and that of the metal from Group VI is advantageously from 5% to 40% by weight of oxide equivalent, with respect to the finished catalyst. When a combination of metals from Group VI and from Group VIII is used, the catalyst is then preferably used in a reduced form.

Under these conditions, the content of unsaturated and oxygen-comprising molecules in the effluent resulting from the hydrotreating stage is reduced to less than 0.5% by weight and to approximately less than 0.1% by weight in general, with respect to the total weight of the effluent.

c) Hydrocracking/Hydroisomerization

In one embodiment according to the invention, the process comprises a hydrocracking and hydroisomerization stage c) in which at least a part and preferably all of the hydrotreated light fraction and of the hydrotreated heavy fraction are sent to a hydrocracking and hydroisomerization unit in the presence of a hydrocracking and hydroisomerization catalyst and which operates at a temperature of between 250° C. et 450° C., at a pressure of between 0.2 and 15 MPa, at a hourly space velocity of between 0.1 $h^{-1}$ and 10 $h^{-1}$, and at a hydrogen flow rate adjusted in order to obtain a ratio of between 100 and 2000 standard litres of hydrogen per litre of feedstock.

Preferably, the hydrocracking and hydroisomerization stage operates at a temperature of between 280 and 450° C. and more preferably still between 320 and 420° C., at a pressure of between 0.5 and 10 MPa, more preferably between 1 and 9 MPa and very preferably between 2 and 8 MPa, at a space hourly velocity of between 0.2 and 7 $h^{-1}$ and more preferably between 0.5 and 5 $h^{-1}$, and at a hydrogen flow rate adjusted in order to obtain a ratio of between 150 and 1500 standard litres of hydrogen per litre of feedstock and more preferably between 300 and 1500 standard litres of hydrogen per litre of feedstock.

The hydrocracking and hydroisomerization catalyst employed advantageously comprises at least one hydro/dehydrogenating metal chosen from the group formed by the metals of Group VIb and of Group VIII of the Periodic Table and at least one Bronsted acid solid, that is to say a solid which can release one or more protons, and optionally a binder.

Preferably, the said hydrocracking and hydroisomerization catalyst comprises either at least one noble metal from Group VIII chosen from platinum and palladium, taken alone or as a mixture, which are active in their reduced form, or at least one non-noble metal from Group VIII chosen from nickel and cobalt in combination with at least one metal from Group VIb chosen from molybdenum and tungsten, taken alone or as a mixture, and preferably used in their sulfided form.

Preferably, the said hydrocracking and hydroisomerization catalyst comprises at least one noble metal from Group VIII chosen from platinum and palladium, taken alone or as a mixture, and preferably platinum, which is/are active in its/their reduced form.

In the case where the said hydrocracking and hydroisomerization catalyst comprises at least one noble metal from Group VIII, the content of noble metal of the said catalyst is advantageously between 0.01% and 5% by weight, with respect to the finished catalyst, preferably between 0.05% and 4% by weight and very preferably between 0.10% and 2% by weight.

In the case where the said hydrocracking and hydroisomerization catalyst comprises at least one metal from Group VIb in combination with at least one non-noble metal from Group VIII chosen from nickel and cobalt, the content of metal from Group VIb of the said catalyst is advantageously, as oxide equivalent, between 5% and 40% by weight, with respect to the finished catalyst, preferably between 10% and 35% by weight, and the content of metal from Group VIII of the said catalyst is advantageously, as oxide equivalent, between 0.5% and 10% by weight, with respect to the finished catalyst, preferably between 1% and 8% by weight and very preferably between 1.5% and 6% by weight.

The metal function is advantageously introduced onto the catalyst by any method known to a person skilled in the art, such as, for example, cokneading, dry impregnation or impregnation by exchange.

Advantageously, the Bronsted acid solid comprises and preferably consists of silica/alumina or zeolite Y.

Optionally, a binder can also be used during the stage of forming the support. A binder is preferably used when the zeolite is employed. The said binder is advantageously chosen from silica ($SiO_2$), alumina ($Al_2O_3$), clays, titanium oxide ($TiO_2$), boron oxide ($B_2O_3$) and zirconia ($ZrO_2$), taken alone or as a mixture. Preferably, the said binder is chosen from silica and alumina and more preferably still the said binder is alumina in all its forms known to a person skilled in art, such as, for example, γ-alumina.

A preferred hydrocracking and hydroisomerization catalyst according to the invention advantageously comprises at least one noble metal, the said noble metal being platinum, and a Bronsted acid solid of silica/alumina type, without any binder. The silica content of the silica/alumina, expressed as percentage by weight, is generally between 1% and 95%, advantageously between 5% and 95%, preferably between 10% and 80% and more preferably still between 20% and 70% and between 22% and 45%. This silica content is perfectly measured using X-ray fluorescence.

Several preferred catalysts used in the hydrocracking and hydroisomerization stage of the process according to the invention are described below.

A preferred hydrocracking and hydroisomerization catalyst used in the process according to the invention comprises a specific silica/alumina. Preferably, the said catalyst comprises from 0.05% to 10% by weight, preferably between 0.1% and 5% by weight, of at least one noble metal from Group VIII, preferably chosen from platinum and palladium (in a preferred way platinum), deposited on a silica/alumina support, without any binder, containing an amount of silica ($SiO_2$) of between 1% and 95%, expressed as percentage by weight, preferably between 5% and 95%, in a preferred way between 10% and 80%, in a very preferred way between 20% and 70% and in an even more preferred way between 22% and 45%, the said catalyst exhibiting:

- a BET specific surface of 100 to 500 $m^2/g$, preferably of between 200 $m^2/g$ and 450 $m^2/g$ and very preferably between 250 $m^2/g$ and 450 $m^2/g$,
- a mean diameter of the mesopores of between 3 nm and 12 nm, preferably of between 3 nm and 11 nm and very preferably between 4 nm and 10.5 nm,
- a pore volume of the pores, the diameter of which is between the mean diameter as defined above, decreased by 3 nm, and the mean diameter as defined above, increased by 3 nm, is greater than 40% of the total pore volume, preferably of between 50% and 90% of the total pore volume and very preferably of between 50% and 70% of the total pore volume,
- a total pore volume of between 0.4 and 1.2 ml/g, preferably between 0.5 and 1.0 ml/g and very preferably between 0.5 and 0.9 ml/g,
- a content of alkali metal or alkaline earth metal compounds of less than 300 ppm by weight and preferably of less than 200 ppm by weight.

The mean diameter of the mesopores is defined as being the diameter corresponding to the cancellation of the curve derived from the mercury intrusion volume obtained from the mercury porosity curve for pore diameters of between 2 and 50 nm. The mean diameter of the mesopores of the catalyst is advantageously measured from the pore distribution profile obtained using a mercury porosimeter.

Preferably, the dispersion of the metal of the said preferred catalyst is advantageously between 20% and 100%, preferably between 30% and 100% and very preferably between 40% and 100% The dispersion, representing the fraction of metal accessible to the reactant with respect to the total amount of metal of the catalyst, is advantageously measured, for example, by $H_2/O_2$ titration or by transmission electron microscopy.

Preferably, the coefficient of distribution of the noble metal of the said preferred catalyst is greater than 0.1, preferably greater than 0.2 and very preferably greater than 0.4. The distribution of the noble metal represents the distribution of the metal inside the catalyst grain, it being possible for the metal to be well or poorly dispersed. Thus, it is possible to obtain platinum which is poorly distributed (for example detected in a ring, the thickness of which is markedly less than the radius of the grain) but well dispersed, that is to say that all the platinum atoms, located in the ring, will be accessible to the reactants. The coefficient of distribution of the noble metal can be measured by an electron probe microanalyser.

The noble metal salt is advantageously introduced by one of the normal methods used to deposit the metal at the surface of a solid. One of the preferred methods is dry impregnation, which consists of the introduction of the metal salt in a volume of solution which is equal to the pore volume of the weight of solid to be impregnated. Before the reduction operation, the catalyst can advantageously be subjected to a calcination, such as, for example, a treatment under dry air at a temperature of 300 to 750° C. and preferably at a temperature equal to 520° C., for 0.25 to 10 hours and preferably for 2 hours.

Another preferred hydrocracking and hydroisomerization catalyst used in the process according to the invention comprises at least one hydro/dehydrogenating element chosen from the group formed by the elements from Group VIb and from Group VIII of the Periodic Table, from 0.01% to 5.5% by weight of oxide of a doping element chosen from phosphorus, boron and silicon and a non-zeolite support based on silica/alumina containing an amount of greater than 5% by weight and less than or equal to 95% by weight of silica ($SiO_2$), the said catalyst exhibiting the following characteristics:

- a mean mesopore diameter, measured by mercury porosimetry, of between 2 and 14 nm,
- a total pore volume, measured by mercury porosimetry, of between 0.1 ml/g and 0.5 ml/g,
- a total pore volume, measured by nitrogen porosimetry, of between 0.1 ml/g and 0.5 ml/g,
- a BET specific surface of between 100 and 550 $m^2/g$,
- a pore volume, measured by mercury porosimetry, contained in the pores with a diameter of greater than 14 nm, of less than 0.1 ml/g, a pore volume, measured by mercury porosimetry, contained in the pores with a diameter of greater than 16 nm, of less than 0.1 ml/g, a pore volume, measured by mercury porosimetry, contained in the pores with a diameter of greater than 20 nm, of less than 0.1 ml/g, a pore volume, measured by mercury porosimetry, contained in the pores with a diameter of greater than 50 nm, of less than 0.1 ml/g, an X-ray diffraction diagram which contains at least the main lines characteristic of at least one of the transition aluminas included in the group composed of α-, ρ-, χ-, η-, γ-, κ-, θ- and δ-aluminas, a tapped packing density of greater than 0,7 g/ml.

Another preferred hydrocracking and hydroisomerization catalyst used in the process according to the invention comprises (and preferably is essentially composed of) from 0.05% to 10% by weight and preferably between 0.1% and 5% by weight of at least one noble metal from Group VIII, preferably chosen from platinum and palladium and preferably the said noble metal being platinum, deposited on a silica/alumina support, without any binder, containing an amount of silica ($SiO_2$) of between 1% and 95%, expressed as percentage by weight, preferably between 5% and 95%, in a preferred way between 10% and 80%, in a very preferred way between 20% and 70% and in an even more preferred way between 22% and 45%, the said catalyst exhibiting:

a BET specific surface of 150 to 600 $m^2/g$ and preferably of between 200 $m^2/g$ and 600 $m^2/g$, a mean diameter of the mesopores of between 3 nm and 12 nm, preferably of between 3 nm and 11 nm and very preferably between 4 nm and 10.5 nm, a pore volume of the pores, the diameter of which is between the mean diameter as defined above, decreased by 3 nm, and the mean diameter as defined above, increased by 3 nm, is greater than 60% of the total pore volume, preferably greater than 70% of the total pore volume and very preferably greater than 80% of the total pore volume, a total pore volume of less than 1 ml/g, preferably of between 0.1 and 0.9 ml/g and very preferably between 0.2 and 0.8 ml/g, a content of alkali metal or alkaline earth metal compounds of less than 300 ppm by weight and preferably of less than 200 ppm by weight.

Preferably, the dispersion of the said preferred catalyst used in the hydrocracking and hydroisomerization stage according to the invention is advantageously between 20% and 100%, preferably between 30% and 100% and very preferably between 40% and 100%.

Preferably, the coefficient of distribution of the noble metal of the said preferred catalyst used in the hydrocracking and hydroisomerization stage is greater than 0.1, preferably greater than 0.2 and very preferably greater than 0.4. This coefficient of distribution is measured by an electron probe microanalyser.

During this stage, the fraction entering the reactor undergoes, in contact with the catalyst and in the presence of hydrogen, essentially hydrocracking reactions which, accompanied by hydroisomerization reactions of the n-paraffins, will make it possible to improve the quality of the products formed and more particularly the cold properties of the kerosene and the gas oil and also to obtain very good yields of middle distillates. The conversion of products having boiling points of greater than or equal to 370° C. to give products having boiling points of less than 370° C. is greater than 50% by weight, often at least 60% and preferably greater than or equal to 70%.

The conversion is defined as:

Conversion of the 370° C.+ to give 370° C.−=[(% by weight of the 370° C.− effluent)−(% by weight of the 370° C.− feedstock)]/[100−(% by weight of the 370° C.−feedstock)], with:

% by weight of the 370° C.− effluent=fraction by weight of compounds having boiling points of less than 370° C. in the effluents, % by weight of the 370° C.− feedstock=fraction by weight of compounds having boiling points of less than 370° C. in the hydrocracking and hydroisomerization feedstock, The effluent resulting from the hydrocracking and hydroisomerization stage no longer contains olefinic compounds and oxygen-comprising compounds and is cracked and isomerized.

d) Separation

The effluent resulting from the hydrocracking/hydroisomerization unit is sent to a fractionation unit to give a middle distillates fraction, a naphtha cut having a maximum boiling point of less than 180° C. and an unconverted heavy fraction having an initial boiling point of greater than 340° C., preferably of greater than 370° C. and preferably of greater than 380° C., also known as UCO or "unconverted oil".

The liquid fraction, unconverted residue, (UCO) containing products having an initial boiling point of greater than 340° C., preferably of greater than 370° C. and in a preferred way of greater than 380° C. and resulting from the distillation can be at least in part recycled in the hydrocracking and hydroisomerization unit located upstream of the fractionation unit in order to increase the yield of middle distillates.

Alternatively, the unconverted heavy fraction can be recovered in order to be upgraded to give a lubricating base.

In the case of shutdown of at least one of the hydrotreating unit (D) and of the hydrocracking/hydroisomerization unit (E), the storage of the products resulting from the Fischer-Tropsch synthesis in vessels has to be provided. In view of the nature of the effluents, the conditions for storage of the products will have to be adjusted.

Storage of the Light Fraction

In order to prevent the formation of undesirable rubbers during the hydrotreating and/or hydrocracking/hydroisomerization stage, the condensates resulting from the light fraction of the Fischer-Tropsch synthesis have to be stored at a temperature of less than 20° C. and more preferably of less than 15° C. and more preferably still of less than 10° C. In addition to a controlled temperature, the condensates should advantageously be stored in an inert atmosphere, by flushing with nitrogen, for example. The flushing with an inert gas is carried out to give slight excess pressure, that is to say by increasing the pressure in the vessel with respect to atmospheric pressure (i.e. 1013.25 hPa) by at most 0.1 MPa, preferably 0.05 MPa and very preferably 0.025 MPa.

The vessel used can be equipped with a floating roof which makes it possible to limit the consumption of inert gas and the stripping of the light hydrocarbons produced in the condensates.

Storage of the Heavy Fraction

In the event of shutdown of the hydrotreating unit and/or of the hydrocracking/hydroisomerization unit, the heavy fraction resulting from the synthesis will have to be stored in a vessel maintained under hot conditions. The temperature will be chosen so as to keep the heavy fraction in its liquid phase. The temperature will advantageously be between 80 and 230° C., preferably between 90 and 175° C. and very preferably between 100 and 150° C. The temperature of the vessel can be maintained via a wall heated with steam or via a liquid recirculation loop on which there is a heat exchanger.

The vessel for storage of the waxes can also be provided with a stirring means. The waxes are stored in an inert atmosphere, by flushing with nitrogen, for example. In the case of flushing, the storage of the waxes is carried out to give slight excess pressure, that is to say by increasing the pressure in the vessel with respect to atmospheric pressure (i.e. 1013.25 hPa) by at most 0.1 MPa, preferably 0.05 MPa and very preferably 0.025 MPa.

BRIEF DESCRIPTION OF THE DRAWINGS

In FIGS. 1 and 2, the same references denote identical or analogous elements.

With reference to FIG. 1, the synthesis gas 1, a gas composed predominantly of carbon monoxide and of hydrogen, is directed to a Fischer-Tropsch synthesis unit (A). The gas fraction under the operating conditions of the Fischer-Tropsch synthesis (A) is composed of the unconverted gas fraction, of the light hydrocarbons part and of the water formed by the Fischer-Tropsch synthesis (A). These three phases are separated by cooling and then flash distillation. The gas fraction is preferably recycled with the synthesis gas 1 so as to increase the total conversion and the material yield. The aqueous fraction is treated before being returned to the process or to the outside. The light hydrocarbon fraction 2, or condensates, is sent to the hydrotreating unit (D) as a mixture 4 with the heavy fraction 3 resulting from the Fischer-Tropsch synthesis (A). This heavy fraction 4, or waxes, corresponds to the liquid fraction under the operating conditions of the reaction section. In normal operation, the condensates 2 and the waxes 4 are sent directly to the hydrotreating stage (D). The objective of the hydrotreating stage (D) is to reduce the content of olefins and to decompose the oxygen-comprising compounds. The hydrotreated effluent 5 resulting from the hydrotreating unit (D) is sent to a hydrocracking/hydroisomerization stage (E). The objective of the hydrocracking/hydroisomerization stage (E) is to increase the yield of middle distillates, kerosene and gas oil, by selective conversion of the fraction having a boiling point of greater than 370° C. to give a hydrocarbon fraction having a boiling point of between 120° C. and 370° C., and to improve the properties of the middle distillates produced by the isomerization of the effluent entering the stage and predominately composed of normal paraffins. The effluent 6 is subsequently sent to a fractionation stage (F) in order to recover, by way of example, a naphtha fraction 7, a kerosene fraction 8 and a gas oil fraction 9. A heavier fraction 10 can also be recycled or recovered in order to be upgraded to give lubricating base. Thus, in this embodiment, the vessels (B,C) for storage respectively of the condensates 2 and of the waxes 3 are not used.

With reference to FIG. 2, in the case of shutdown of the hydrotreating unit (D) and/or of the hydrocracking/hydroisomerization unit (E), storage of the condensates 2 in a vessel (B) is necessary. This storage has to be carried out under the operating conditions as described above. Analogously, storage of the waxes 3 in a vessel (C) has to be provided under the operating conditions as described above. These storages make it possible to keep the Fischer-Tropsch synthesis unit in operation, which unit is more complex to restart than the hydrotreating and/or hydrocracking/hydroisomerization units. In the case of the hydrocracking/hydroisomerization unit (E), storage of the effluent 5 can also be provided in a storage unit (not represented in FIG. 2), which can be recycled upstream of the hydrotreating unit (D) (not represented in FIG. 2).

Figure 1:
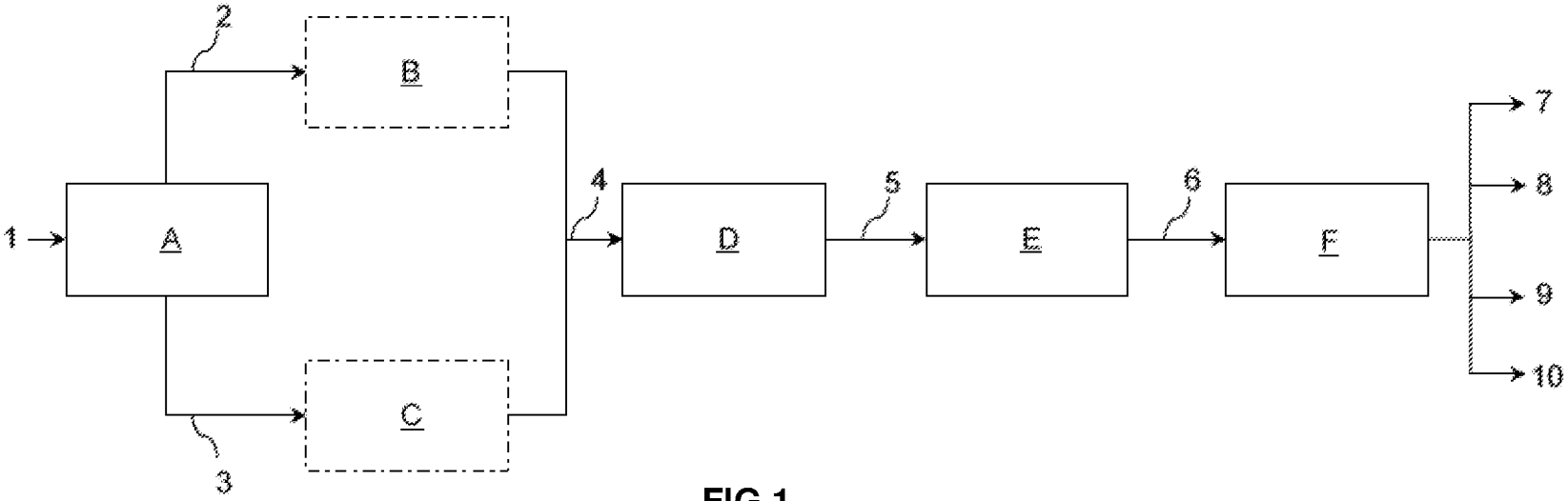
FIG. 1 illustrates an embodiment of the process for the production of middle distillates according to the invention in which the hydrotreating unit (D) and the hydrocracking/hydroisomerization unit (E) are in operation. The vessels (B) and (C) are not used to store the effluents resulting from the Fischer-Tropsch unit.
Figure 2:
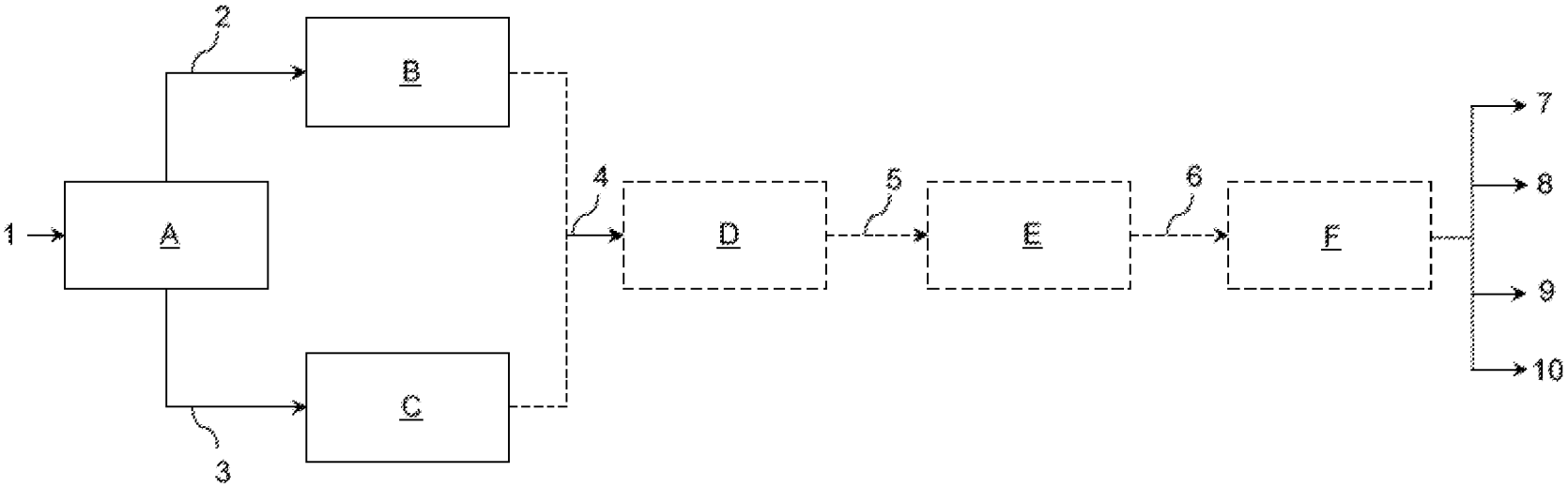
FIG. 2 illustrates an embodiment of the process for the production of middle distillates according to the invention in which the hydrotreating unit (D) is not operating. The vessels (B) and (C) are used to store the effluents resulting from the Fischer-Tropsch unit.

The examples presented below illustrate the invention without limiting the scope thereof.

EXAMPLES

The aim of the examples below is to demonstrate the importance of the operating conditions for storage of the light fraction 2 (or condensates) of the paraffinic feedstock resulting from the Fischer-Tropsch unit (A) in the vessel (B).

In order to do this, the maleic anhydride value (MAV) was used. This value is related to the property which conjugated olefinic double bonds have of being able to add to maleic anhydride. The MAV value is expressed in milligrams of anhydride consumed per gram of product subjected to the test. The objective of the method in the case of the present invention is to quantitatively determine the conjugated diolefins which are precursors of rubbers. The results are presented in Table 1 below.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding French application No. 18/56.668, filed Jul. 18, 2018, are incorporated by reference herein.

Example 1 According to the Invention

In this example, the condensates produced by Fischer-Tropsch synthesis are stored in a vessel (B) at a temperature of 8° C.

Example 2 (Comparative)

In this example, the condensates produced by Fischer-Tropsch synthesis are stored in a vessel (B) at a temperature of 35° C.

TABLE 1

MAV value of the condensates stored in the vessel according to the temperature

| | Storage temperature (° C.) | MAV value (mg/g) |
|---|---|---|
| Example 1 (in accordance with the invention) | 8 | 16.5 |
| Example 2 (comparative) | 35 | 42.0 |

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for the production of middle distillates from a paraffinic feedstock produced by Fischer-Tropsch synthesis comprising at least the following stages:

a) the said paraffinic feedstock resulting from a Fischer-Tropsch unit (A) is recovered, the said paraffinic feedstock comprising at least a light fraction (2), known as condensate, and a heavy fraction (3), known as waxes;

b) a least a part of the said light fraction and at least a part of the said heavy fraction which are obtained on conclusion of stage a) are sent, as a mixture (4), to a hydrotreating unit (D) in the presence of hydrogen and a hydrotreating catalyst to obtain a first hydrotreated effluent (5);

c) at least a part of the first hydrotreated effluent (5) obtained on conclusion of stage b) is sent to a hydrocracking/hydroisomerization unit (E) in the presence of hydrogen and of a hydrocracking/hydroisomerization catalyst to obtain a second effluent (6);

d) the second effluent (6) resulting from the hydrocracking/hydroisomerization unit is separated in a fractionation unit (F) to obtain at least a naphtha cut (7) having a maximum boiling point of less than 180° C., a middle distillates fraction (8,9) and an unconverted heavy fraction (10);

which process is characterized by periodic shutdowns of the hydrotreating unit and/or hydrocracking/hydroisomerization unit and when the hydrotreating unit (D) and/or the hydrocracking/hydroisomerization unit (E) is at shutdown, then:

the said light fraction (2) obtained on conclusion of stage a) is stored in a vessel (B) maintained under an inert atmosphere and in which the temperature inside the vessel is maintained at a value of less than 20° C.; and/or the said heavy fraction (3) obtained on conclusion of stage a) is stored in a vessel (C) maintained under an inert atmosphere and in which the temperature inside the vessel is maintained at a value of between 80 and 230° C.

2. The process according to claim 1, in which the said light fraction (2) is stored in the vessel (B) at a temperature of less than 15° C.

3. The process according to claim 1, in which the vessel (B) is maintained under an inert atmosphere by flushing by an inert gas and by creating an excess pressure of at most 0.1 MPa with respect to the pressure within the said vessel (B).

4. The process according to claim 1 in which the said light fraction exhibits an initial boiling point $T_1$ of between 15 and 50° C.

5. The process according to claim 1, in which the said heavy fraction exhibits an initial boiling point $T_2$ of between 100 and 300° C.

6. The process according to claim 1, in which the hydrotreating unit is operated at a temperature of between 250 and 450° C., at a pressure of between 0.5 and 15 MPa, an hourly space velocity of between 0.1 and 40 $h^1$ and a hydrogen flow rate adjusted to obtain a ratio of between 100 and 3000 standard litres per litre.

7. The process according to claim 1, in which the hydrocracking/hydroisomerization stage c) is carried out unit is operated at a temperature of between 250° C. and 450° C., at a pressure of between 0.2 and 15 MPa, at an hourly space velocity of between 0.1 $h^{-1}$ and 10 $h^{-1}$ and at a hydrogen flow rate adjusted to obtain a ratio of between 100 and 2000 standard litres of hydrogen per litre of feedstock.

8. The process according to claim 1, in which the hydrocracking/hydroisomerization catalyst comprises at least one hydro/dehydrogenating metal selected from the group consisting metals of Group VIb and of Group VIII of the Periodic Table and at least one Bronsted acid solid, and optionally a binder.

9. The process according to claim 8, in which the said metal from Group VIII is platinum or palladium, taken alone or as a mixture, which is/are active in its/their reduced form.

10. The process according to claim 1, in which the hydrotreating catalyst comprises at least one metal selected from the group consisting of nickel, molybdenum, tungsten, cobalt, ruthenium, indium, palladium and platinum, alone or as a mixture, and comprises at least one support selected from the group consisting of aluminas, boron oxides, magnesia, zirconia, titanium oxides and clays or a combination of these oxides.

11. A process for the storage of a light fraction of an effluent resulting from the Fischer-Tropsch synthesis, the said light fraction exhibiting an initial boiling point $T_1$ of between 15 and 50° C., the said light fraction being stored in a vessel maintained under an inert atmosphere and in which the temperature inside the vessel is maintained at a value of less than 20° C.

* * * * *